US008499733B2

(12) United States Patent
Zwahr et al.

(10) Patent No.: US 8,499,733 B2
(45) Date of Patent: Aug. 6, 2013

(54) DEVICE FOR ADJUSTING THE ROTATION ANGLE POSITION OF A CAMSHAFT

(75) Inventors: Sebastian Zwahr, Obermichelbach (DE); Jens Schafer, Herzogenaurach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 13/636,401

(22) PCT Filed: Mar. 29, 2011

(86) PCT No.: PCT/EP2011/054792

§ 371 (c)(1),
(2), (4) Date: Sep. 21, 2012

(87) PCT Pub. No.: WO2011/134729

PCT Pub. Date: Nov. 3, 2011

(65) Prior Publication Data

US 2013/0023349 A1 Jan. 24, 2013

(30) Foreign Application Priority Data

Apr. 26, 2010 (DE) ..... 10 2010 018 210

(51) Int. Cl.
*F01L 1/34* (2006.01)

(52) U.S. Cl.
USPC ..... 123/90.17; 123/90.15; 123/90.16; 464/160

(58) Field of Classification Search
USPC ..... 123/90.15, 90.16, 90.17, 90.18; 464/1, 464/2, 160
See application file for complete search history.

(56) References Cited

U.S. PATENT DOCUMENTS 6,250,267 B1 * 6/2001 Methley ..... 123/90.17

FOREIGN PATENT DOCUMENTS

| | | |
|---|---|---|
| DE | 4101676 | 7/1992 |
| EP | 1030036 | 8/2000 |
| EP | 2067944 | 6/2009 |
| JP | 5133208 | 5/1993 |
| WO | 2009069425 | 6/2009 |

* cited by examiner

*Primary Examiner* — Ching Chang
(74) *Attorney, Agent, or Firm* — Volpe and Koenig, P.C.

(57) ABSTRACT

A device for adjusting the relative rotation angle position of a rotating shaft (1), in particular of a camshaft, relative to a drive element (2), including a substantially hollow-cylindrical displacement member (3), which is arranged coaxially to the shaft (1) and to the drive element (2) and is coupled to the shaft (1) and to the drive element (2) such that an axial displacement of the displacement member (3) effects an adjustment of the relative rotation position of the shaft (1) relative to the drive element (2), and an actuating unit (4) for axially displacing the displacement member (3), the actuating unit comprising two brake actuators (5, 6) and two counter-rotating threaded drives (7, 8) for coupling the brake actuators (5, 6) to the displacement member (3) such that, upon selective actuation of a brake actuator (5, 6), an axial displacement of the displacement member (3) takes place in one direction or the other. According to the invention, at least one threaded drive (7) of the actuating unit (4) is at least partially accommodated in the shaft (1) that is to be adjusted, wherein the accommodated part of the threaded drive (7) comprises a spindle section (9) that is arranged coaxially to the shaft (1) and a nut (10) which can be axially moved with respect to the spindle section (9) and which is connected such to a section of the displacement member (3) that is likewise accommodated in the shaft (1) that an axial movement of the nut (10) effects an axial displacement of the displacement member (3) in a first direction.

8 Claims, 1 Drawing Sheet

DEVICE FOR ADJUSTING THE ROTATION ANGLE POSITION OF A CAMSHAFT

FIELD OF THE INVENTION

The invention relates to a device for adjusting the relative rotation angle position of a rotating shaft, in particular of a camshaft, with respect to a drive element.

BACKGROUND

A device of this kind is also known from the prior art as a phase adjuster or a camshaft adjuster inasmuch as the shaft to be adjusted is a camshaft, for example. However, the invention is not restricted to use as a camshaft adjuster but can be applied similarly to any rotating adjustment shafts, e.g. to adjustment shafts for adjusting the valve lift of mechanically variable valve mechanisms.

An adjusting device for a camshaft is disclosed by DE 41 01 676 A1, for example. It comprises an actuating element, which is operatively connected to the shaft to be adjusted and to a drive wheel via inner and outer splines. One set of splines is designed as helical toothing, and therefore an axial movement of the actuating element brings about an adjustment of the rotation angle position of the camshaft with respect to the drive element in accordance with the principle of inclined planes. In this case, the actuating element is actuated by an electric motor.

Concepts which employ one or more brake actuators to adjust the rotation angle position of a camshaft with respect to a drive element are furthermore known from the prior art. When a brake actuator is employed, adjustment can be brought about in only one direction of adjustment. For adjustment in the other direction, a spring can then be employed, for example. However, spring-actuated adjustment has the disadvantage that a continuously acting force is produced by the spring. Retention of a particular position of adjustment thus requires an opposing force, which must in turn be applied by the brake actuator. Accordingly, the spring force selected should be as low as possible. A high spring force, on the other hand, has an advantageous effect on the dynamics of the adjusting system. There is therefore a conflict if both a low retention force and high dynamics are to be ensured. The speed of adjustment of a spring-actuated adjusting system is furthermore dependent on the speed, load and temperature of the internal combustion engine, and therefore very great time differences are often achieved. Moreover, the achievable speed of adjustment is below that of a brake-actuated adjusting system.

EP 2 067 944 A1 has disclosed a device which employs two brake actuators to adjust the rotation angle position of the camshaft with respect to a drive wheel. The brake actuators serve to move an intermediate member axially, said intermediate member being coupled to a shaft section and to a drive wheel in such a way that the axial movement of the intermediate member brings about an adjustment of the relative rotation angle position of the shaft section with respect to the output wheel. Here, the shaft section serves merely to extend the camshaft. For coupling to the intermediate member, each brake actuator comprises a rotating annular coupling member, which is operatively connected to the intermediate member in such a way that a change in the rotational speed of a coupling member due to the actuation of a brake actuator brings about a difference in speed and hence an axial movement of the intermediate member. Alternate actuation of the brake actuators thus leads to braking of one or the other coupling member, with the result that a movement of the intermediate member takes place in one or the other direction of adjustment. By means of the axial movement of the intermediate member, the rotation angle position of the camshaft with respect to the drive wheel is finally adjusted.

SUMMARY

Starting from the abovementioned prior art, it is the object of the present invention to provide an alternative adjusting device, which is furthermore of simple construction and is particularly compact. In particular, the intention is that the device should require the minimum possible installation space in the radial direction.

This object is met by the device having at least some of the features of the invention.

The device proposed for adjusting the relative rotation angle position of a rotating shaft, in particular of a camshaft, with respect to a drive element, comprises a substantially hollow-cylindrical translational member, which is arranged coaxially with the shaft and with the drive element and is coupled to the shaft and to the drive element in such a way that an axial movement of the translational member brings about an adjustment of the relative rotation position of the shaft with respect to the drive element, and an actuating unit for moving the translational member axially, said actuating unit comprising two brake actuators and two counter-rotating screw drives for coupling the brake actuators to the translational member such that, upon selective actuation of a brake actuator, an axial movement of the translational member takes place in one direction or the other. According to the invention, at least one screw drive of the actuating unit is accommodated at least partially in the shaft to be adjusted, wherein the accommodated part of the screw drive comprises a spindle section, which is arranged coaxially with the shaft, and a nut, which can be moved axially with respect to the spindle section and which is connected in such a way to a section of the translational member which is likewise accommodated in the shaft that an axial movement of the nut brings about an axial movement of the translational member in a first direction.

The proposed arrangement of the adjusting device, in which parts of the device are arranged within the shaft to be adjusted, is distinguished, on the one hand, by the fact that it requires little radial installation space. On the other hand, the at least partial arrangement of the device within the shaft to be adjusted has the effect that the effective diameter is relatively small, namely smaller than the diameter of the shaft to be adjusted. Thus, the mass moment of inertia that has to be overcome in each adjusting operation is also kept low. A low mass moment of inertia is associated, in turn, with highly dynamic adjustment with, at the same time, a low energy requirement, with the result that the adjusting device indicated furthermore has a high efficiency.

To optimize efficiency, it is furthermore proposed to design at least one of the two counter-rotating screw drives for coupling the brake actuators to the translational member, preferably the screw drive accommodated in the shaft, as a non-self-locking ball screw drive since the frictional forces arising at the respective contact surfaces are thereby reduced. A reduction in the frictional forces is associated, in turn, with a low energy requirement for the device, with the result that the power electronics that may be used to actuate the device can be correspondingly smaller. At the same time, the onboard electrical system is relieved of load and fuel consumption is reduced.

The additional screw drive of the actuating unit is preferably accommodated at least partially in the drive element or in the shaft to be adjusted, wherein the accommodated part of the screw drive comprises a spindle section designed as a hollow shaft and a nut, which can be moved axially with respect to the spindle section and is connected in such a way to a section of the translational member which is likewise accommodated in the drive element that an axial movement of the nut brings about an axial movement of the translational member in a second direction. The additional screw drive is also preferably designed as a non-self-locking ball screw drive in order to bring about a reduction in the frictional forces and an associated reduction in the energy requirement. For example, the first screw drive, which is accommodated in the shaft, can be designed as a right-handed screw drive and the second screw drive, which is preferably accommodated in the drive element, can be designed as a left-handed screw drive or vice versa. The drive element can comprise a drive wheel and a hub for connecting the drive element to the shaft, for example. The diameter selected for the hub is then preferably substantially the same as the diameter selected for the shaft and, as a result, the components belonging to the second screw drive are also accommodated within a small effective diameter. This part of the adjusting device too, therefore, requires little radial installation space and furthermore has a low mass moment of inertia, thus ensuring a further optimization in the efficiency of the device.

The proposed design for the second spindle section as a hollow shaft allows a particularly compact design of the device, both in the radial and in the axial direction. This is because the spindle section designed as a hollow shaft is simply pushed on to make the connection with the first spindle section or with a spindle section extension designed as a solid shaft. For this purpose, the solid-shaft extension of the first spindle section can have a section of smaller outside diameter, ensuring that the overall outside diameter hardly differs from said section, if at all. Moreover, a radially extending offset can be provided in the region of the reduction in diameter to form a stop acting in the axial direction.

Moreover, the spindle sections of the two counter-rotating screw drives, which are preferably designed as a solid shaft and a hollow shaft, are connected in such a way that they are supported in a manner which allows them to rotate relative to one another. This is because the actuation of a brake actuator results in the respectively braked spindle section rotating more slowly than the other spindle section so as to effect phase adjustment. In this process, the nut of the more slowly rotating spindle section moves the translational member in an axial direction predetermined by the pitch of the screw drive, with the nut of the other spindle section also undergoing a movement in the same direction. Owing to the opposed directions of rotation of the screw drives, the other, unbraked spindle section undergoes an acceleration as a result. However, this assumes that the two spindle sections are supported in a manner which allows them to rotate relative to one another. This example shows that adjustment based on the principle of using two brake actuators only works if the mechanical coupling between the two brake actuators is made by transmission elements of very high efficiency. In this way, it is possible to reliably avoid self-locking of the two counter-rotating screw drives.

For nonpositive and/or positive connection of a nut of a screw drive to the translational member, it is furthermore proposed that at least one nut of a screw drive is supported in the axial direction on a supporting surface of the translational member. The supporting surface thus serves as a driver edge, which causes the translational member to be taken along during an axial movement of the nut. It is preferable if both nuts are supported on such a supporting surface of the translational member, support being given in such a way that there is movement of the translational member in one or the other direction, depending on the respectively actuated nut.

It is advantageous if the translational member is coupled to the shaft and/or to the drive element by at least one oblique ball guide. An oblique ball guide in the sense in which this term is used in the present invention acts on the principle of inclined planes, similarly to the helical toothing mentioned at the outset and known from the prior art. That is to say, a torque can be produced by applying an axial load and vice versa. For this purpose, the translational member has ball guides in the form of obliquely extending grooves arranged on the outer circumference, said grooves being embodied so as to rise and fall in a manner comparable with a thread. In contrast to the helical toothing, however, the oblique ball guide allows low-friction adjustment of the components that are coupled to one another since the motion of the components relative to one another is brought about by a low-friction rolling motion of the balls. Through appropriate coupling, it is thus possible to achieve a reduction in the frictional forces. The translational member preferably has two guide sections designed as opposing oblique ball guides, one of them serving to couple the translational member to the shaft and the other serving to couple the translational member to the drive element. In this case, the selected pitch of the two opposing oblique ball guides can be the same or different. As an alternative, it is also possible for a guide section provided for coupling the translational member to the shaft or to the drive element to be designed as a linear guide with a plurality of linear grooves rather than as an oblique ball guide. Such an embodiment too ensures that an axial movement of the translational member simultaneously brings about a rotation of the components coupled to the translational member by the guide sections relative to one another. This is because the use of at least one oblique ball guide for coupling the translational member to the shaft and/or to the drive element ensures that a linear motion of the translational member is converted into a rotary motion of a component coupled to the translational member. In this arrangement, the transmission ratio can be defined by means of the respectively selected pitch of the at least one oblique ball guide.

To achieve high positioning accuracy of the adjusting device, a high overall transmission ratio is preferably selected. Moreover, the overall transmission ratio of the rotation angle position of the drive element with respect to the rotation angle position of the shaft to be adjusted is preferably between 1:20 and 1:100.

According to a preferred embodiment of the invention, the two brake actuators of the actuating unit of the adjusting device are electrically actuated. As an alternative, it is also possible for the actuation of the brake actuators to be performed hydraulically. Moreover, brake actuators that operate frictionally or without contact can be used. Depending on the respectively selected specific embodiment of the two brake actuators, the energy requirement of the device according to the invention can be further optimized by virtue, for example, of a reduction in the frictional forces.

BRIEF DESCRIPTION OF THE DRAWINGS

A preferred embodiment of the invention is explained in greater detail below with reference to the attached drawings, in which:

FIG. 3 shows a perspective view of a cage for the oblique ball guide in FIG. 2.

DETAILED DESCRIPTION OF THE PREFERRED EMBODIMENTS

Figure 1:
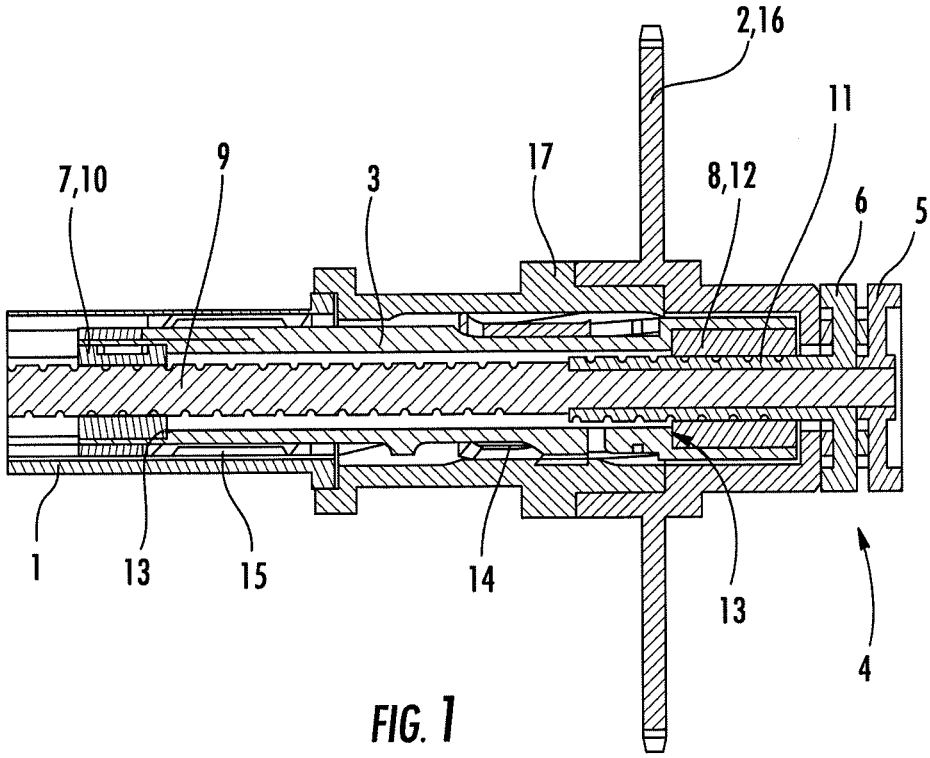
FIG. 1 shows a longitudinal section view through a device according to the invention.

The device illustrated in FIG. 1 comprises a drive element 2, including a drive wheel 16 with an attached hub 17 and a shaft 1, which in the present case is designed as a camshaft. The shaft 1 and the hub 17 each have a collar region, by means of which they are supported on one another in the axial direction. The connection between the shaft 1 and the hub 17 of the drive element 2 is furthermore designed in such a way that a relative rotation of the shaft 1 with respect to the hub 17 or the drive element 2 can be performed in order to allow phase adjustment. For this purpose, an adjusting device comprising a translational member 3 and an actuating unit 4 is arranged substantially within the diameter of the shaft 1 and of the hub 17. The translational member 3 is likewise of hollow-cylindrical design and has a first section, which is accommodated in the shaft 1, and a second section, which is accommodated within the hub 17, wherein the first section is coupled to the shaft 1 by way of an axial ball guide 15, and the second section is coupled to the hub 17 by way of an oblique ball guide 14. The coupling of the translational element 3 to the shaft 1 does not necessarily have to be accomplished by means of an axial ball guide 15. As an alternative, an additional oblique ball guide can be provided for coupling to the shaft 1, but this ball guide must then be opposed to the oblique ball guide 14 of the other section of the translational member.

The way in which the translational member 3 is coupled to the shaft 1 and the hub 17 ensures that an axial movement of the translational member 3 brings about an adjustment of the relative rotation angle position of the shaft 1 with respect to the drive wheel 16.

The axial movement of the translational member 3 is indicated by the actuating unit 4. This comprises two brake actuators 5 and 6, which are each coupled by a screw drive 7, 8 to the translational member 3. The screw drives 7, 8 are embodied as non-self-locking ball screw drives and operate in opposite directions.

Figure 2:
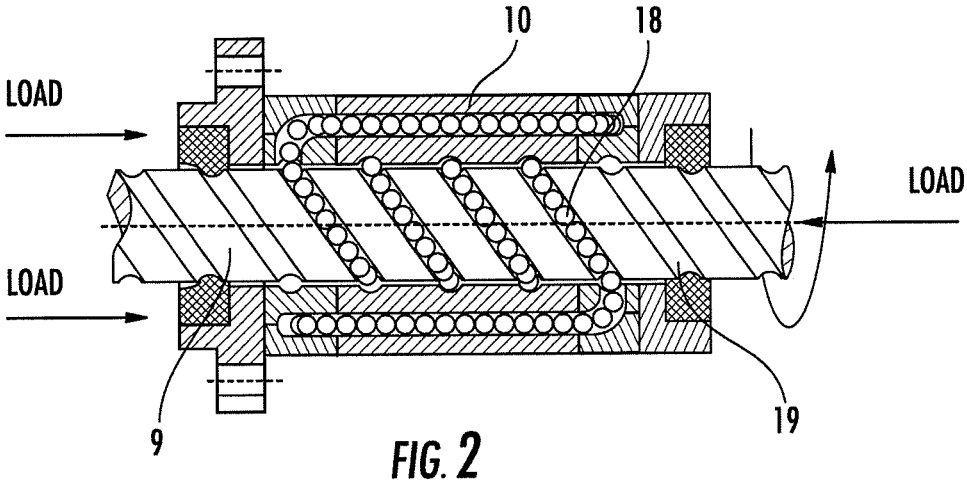
FIG. 2 shows a perspective view of an oblique ball guide.

The principal of operation of a ball screw drive is illustrated by way of example in FIG. 2. The coupling of the translational member 3 to the actuating unit 4 can be designed in a corresponding manner. In this case, screw drive 7 comprises a spindle section 9, on the outer circumference of which a helical groove 19 is formed to accommodate balls 18. The groove 19 interacts in such a way with further mating grooves formed in a nut 10 that an axial movement of the nut 10 brings about a rotary motion of the spindle 9 and a rotary motion of the spindle 9 brings about an axial movement of the nut 10. The ball screw drive illustrated in FIG. 2 can thus convert a rotary motion into a linear, translational motion or a linear, translational motion into a rotary motion. In this arrangement, the pitch of the helical groove 19 determines the transmission ratio and the respective direction of motion.

As illustrated in FIG. 1, each of the two counter-rotating screw drives 7, 8 has a nut 10, 12, which, for the purpose of mechanical coupling to the translational member 3, is supported on a radially extending supporting surface 13 of the translational element 3. An axial load can thus be applied in both directions via the nuts 10, 12, a movement of the nuts 10, 12 in one direction or the other bringing about a rotary motion of the respective spindle sections 9, 11 of the screw drives 7, 8 interacting with the nuts 10, 12. When a brake actuator 5, 6 is actuated, it being possible for actuation to be performed electrically or hydraulically, the rotational speed of the spindle section associated with the braking device is reduced, while the other spindle section in each case undergoes acceleration. Due to the difference in speed, the translational member 3 is moved in the axial direction by way of the nuts 10, 12. The coupling of the translational member 3 to the shaft 1 and to the drive element 2 in turn has the effect that a phase adjustment takes place during this process.

In order to achieve a compact configuration of the device, especially in the radial direction, the translational member 3 and the two counter-rotating screw drives 7, 8 are arranged within the diameter of the shaft 1 and of the hub 17. Spindle section 9 of screw drive 7 is designed as a solid shaft, which is passed through spindle section 11, designed as a hollow shaft, of screw drive 8, thus enabling the two brake actuators 5, 6 to be arranged one behind the other in the axial direction. The illustrated device according to the invention thus requires very little installation space in the radial direction. Due to the radially compact configuration of the device, the mass moment of inertia to be overcome during an adjustment is low, and the device thus has highly dynamic adjustment and a high efficiency. The coupling of the individual components by way of oblique ball guides or ball screw drives in turn allows a friction-optimized embodiment of the device, the actuation of which thus requires little energy. Due to the above-mentioned advantages, the device illustrated is suitable especially as a camshaft adjuster in a motor vehicle. Moreover, other uses are possible, and these are likewise the subject matter of the present invention.

LIST OF REFERENCE SIGNS

1 shaft
2 drive element
3 translational member
4 actuating unit
5 brake actuator
6 brake actuator
7 screw drive
8 screw drive
9 spindle section
10 nut
11 spindle section
12 nut
13 supporting surface
14 oblique ball guide
15 axial ball guide
16 drive wheel
17 hub
18 ball
19 groove

The invention claimed is:

1. A device for adjusting a relative rotation angle position of a rotating shaft with respect to a drive element, comprising a substantially hollow-cylindrical translational member, which is arranged coaxially with the rotating shaft and with the drive element and is coupled to the rotating shaft and to the drive element such that an axial movement of the hollow-cylindrical translational member brings about an adjustment of the relative rotation position of the shaft with respect to the drive element, and an actuating unit for moving the hollow-cylindrical translational member axially, said actuating unit comprising two brake actuators and two counter-rotating screw drives for coupling the brake actuators to the hollow-cylindrical translational member such that, upon selective actuation of one of the brake actuators, an axial movement of the translational member takes place in one direction or the other, at least a first one of the screw drives of the actuating unit is accommodated at least partially in the rotating shaft to be adjusted, wherein the accommodated part of the first screw drive comprises a spindle section, which is arranged coaxially with the rotating shaft, and a nut, which can be moved axially with respect to the spindle section and which is connected in a way to a section of the hollow-cylindrical translational member which is also accommodated in the rotating shaft that an axial movement of the nut brings about an axial movement of the hollow-cylindrical translational member in a first direction.

2. The device as claimed in claim 1, wherein a second one of screw drive of the actuating unit is accommodated at least partially in the drive element or in the shaft to be adjusted, wherein the accommodated part of the second screw drive comprises a spindle section designed as a hollow shaft and a nut, which can be moved axially with respect to the spindle section and is connected to a section of which is also accommodated in the drive element that an axial movement of the nut brings about an axial movement of in a second direction.

3. The device as claimed in claim 2, wherein the spindle sections of the two counter-rotating screw drives are supported in a manner which allows them to rotate relative to one another.

4. The device as claimed in claim 2, wherein at least one of the nuts of one of the screw drive is supported in the axial direction on a supporting surface of the hollow-cylindrical translational member.

5. The device as claimed in claim 2, wherein the hollow-cylindrical translational member is coupled to at least one of the shaft or to the drive element by at least one oblique ball guide.

6. The device as claimed in claim 1, wherein an overall transmission ratio of a rotation angle position of the drive element with respect to a rotation angle position of the shaft to be adjusted is between 1:20 and 1:100.

7. The device as claimed in claim 1, wherein the two brake actuators are electrically or hydraulically actuable.

8. The device as claimed in claim 1, wherein the two brake actuators operate frictionally or without contact.

* * * * *